United States Patent [19]

Fabbri

[11] Patent Number: 5,008,790

[45] Date of Patent: Apr. 16, 1991

[54] FLUORESCENT-TYPE FIXTURE HAVING REMOVABLE FOLD-OUT LAMP SOCKETS

[75] Inventor: William C. Fabbri, Billerica, Mass.

[73] Assignee: Genlyte, Inc., Wilmington, Mass.

[21] Appl. No.: 323,285

[22] Filed: Mar. 14, 1989

[51] Int. Cl.[5] ..... F21S 3/00

[52] U.S. Cl. ..... 362/220; 362/285

[58] Field of Search ..... 362/220, 285, 287, 429, 362/199, 260

[56] References Cited

U.S. PATENT DOCUMENTS

| | | | |
|---|---|---|---|
| 2,539,974 | 1/1951 | Riddell | 362/199 |
| 2,958,763 | 11/1960 | Bodian | 362/220 |
| 3,909,100 | 9/1975 | Hodge, Jr. | 362/220 |
| 4,422,132 | 12/1983 | Trowbridge | 362/220 |

*Primary Examiner*—Ira S. Lazarus
*Assistant Examiner*—Sue Hagarman
*Attorney, Agent, or Firm*—Kane, Dalsimer, Sullivan, Kurucz, Levy, Eisele and Richard

[57] ABSTRACT

A fluorescent light fixture is provided which includes a housing with an inwardly extending L-shaped tab. This inwardly extending L-shaped tab engages a channel in a removable socket assembly. The channel of the socket assembly can be slid into the tab so that the socket assembly, along with the sockets themselves, is in a protected position within the housing. The channel is expanded so as to permit the rotating of the socket assembly thereby bringing the sockets into position to engage fluorescent light bulbs when desired.

5 Claims, 4 Drawing Sheets

FLUORESCENT-TYPE FIXTURE HAVING REMOVABLE FOLD-OUT LAMP SOCKETS

BACKGROUND OF THE INVENTION

The present invention relates to fluorescent-type lighting fixtures, particularly to fixtures with removable fold-out lamp socket assemblies.

Fluorescent-type light fixtures are well-known in the prior art. However, such conventional fixtures are deficient in that the socket assemblies into which the ends of the bulbs are placed are fragile, and in precarious positions during shipping. Further, such conventional fixtures are deficient in not allowing the fast and reliable replacement of the sockets. U.S. Pat. No. 4,422,132 allows replacement of the socket assemblies, but requires an awkward rotating and securing of the socket assemblies which is made more difficult by the bending or deformation of the socket assembly or of the fixture itself.

It is therefore an object of this invention to allow a socket assembly to be securely fastened to but remain easily removable from a fluorescent light housing.

It is therefore a further object of this invention to provide a fluorescent light fixture which can be transported with the socket assembly in a secure or folded position.

It is therefore a further object of this invention to provide a socket assembly which can be easily attached to a fluorescent light fixture without deforming the fixture.

It is therefore a still further object of this invention to provide such a socket assembly and fixture apparatus which can be easily manufactured.

SUMMARY OF THE INVENTION

The above and other beneficial objects and advantages are attained in accordance with the present invention by providing a fluorescent light fixture with a housing of an inverted U-shaped cross section, wherein an inwardly extending L-shaped vertical tab is formed on both legs of the U proximate to both ends of the fixture.

A socket assembly is provided with channels which are adapted to engage the inwardly extending L-shaped vertical tabs of the fixture thereby allowing the socket assembly to slide between the legs of the U-shaped housing thereby the socket assembly being rotated ninety degrees from its working or ordinary position. As the socket assembly is engaged entirely between the legs of the fixture, the socket assembly is in a secure position for transport.

The channels include an interior portion which opens to two quarter circles of a common center, and of a diameter equal to the length of the tab. These quarter circles provide a means for the socket assembly to rotate ninety degrees within the housing so as to extend the socket assembly into its normal position so as to engage a fluorescent light bulb.

DETAILED DESCRIPTION OF THE PREFERRED EMBODIMENT

Figure 1:
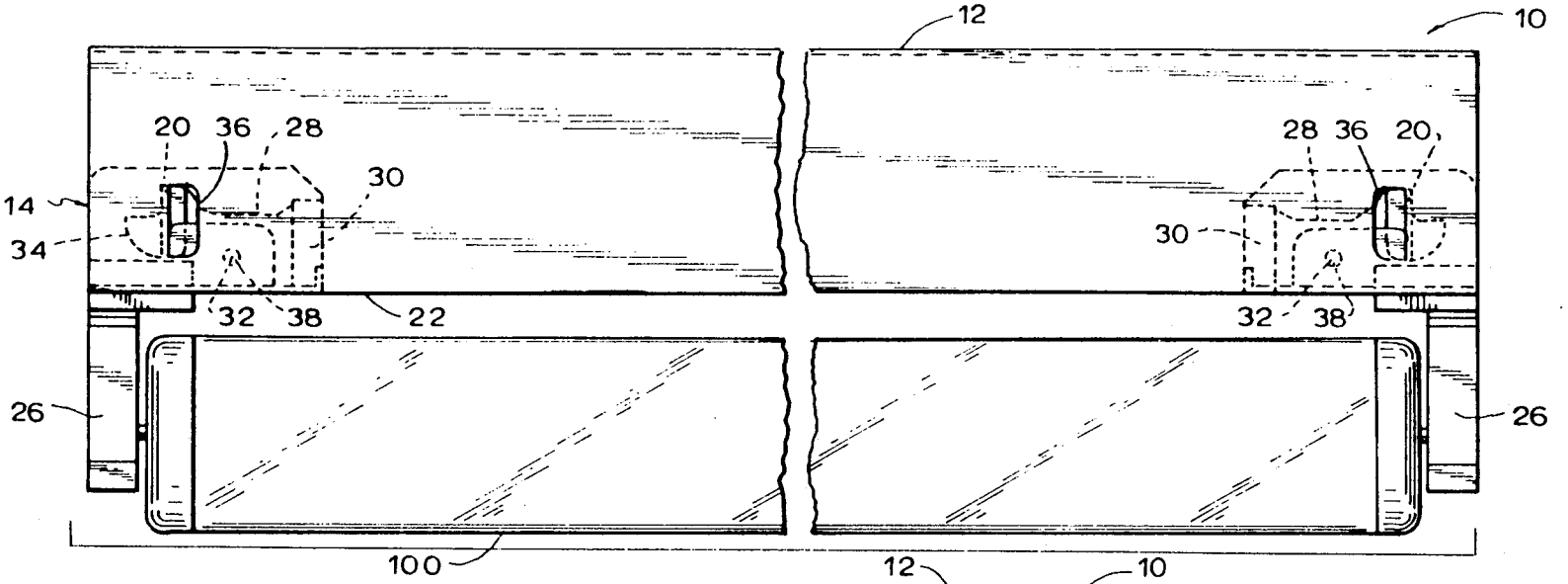
FIG. 1 is a side plan view, partly in cross section, of the present invention with the socket assembly extended so as to engage a fluorescent light bulb.
Figure 2:
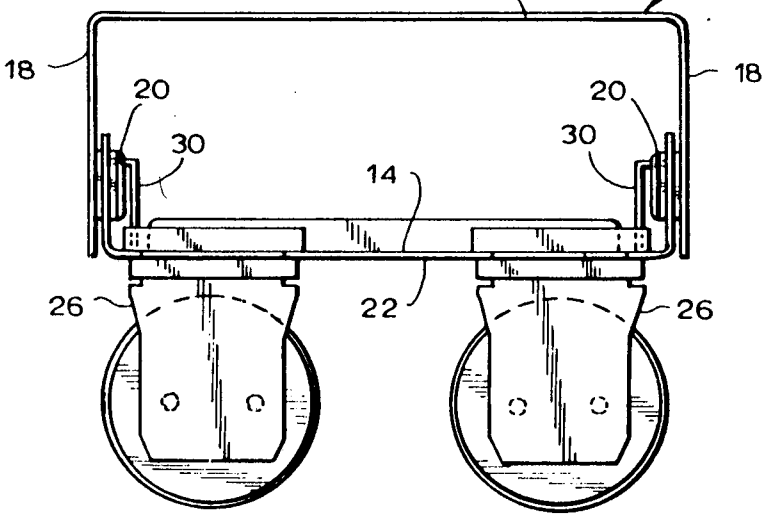
FIG. 2 is an end plan view of the present invention with the socket assembly extended so as to engage a fluorescent light bulb.
Figure 3:
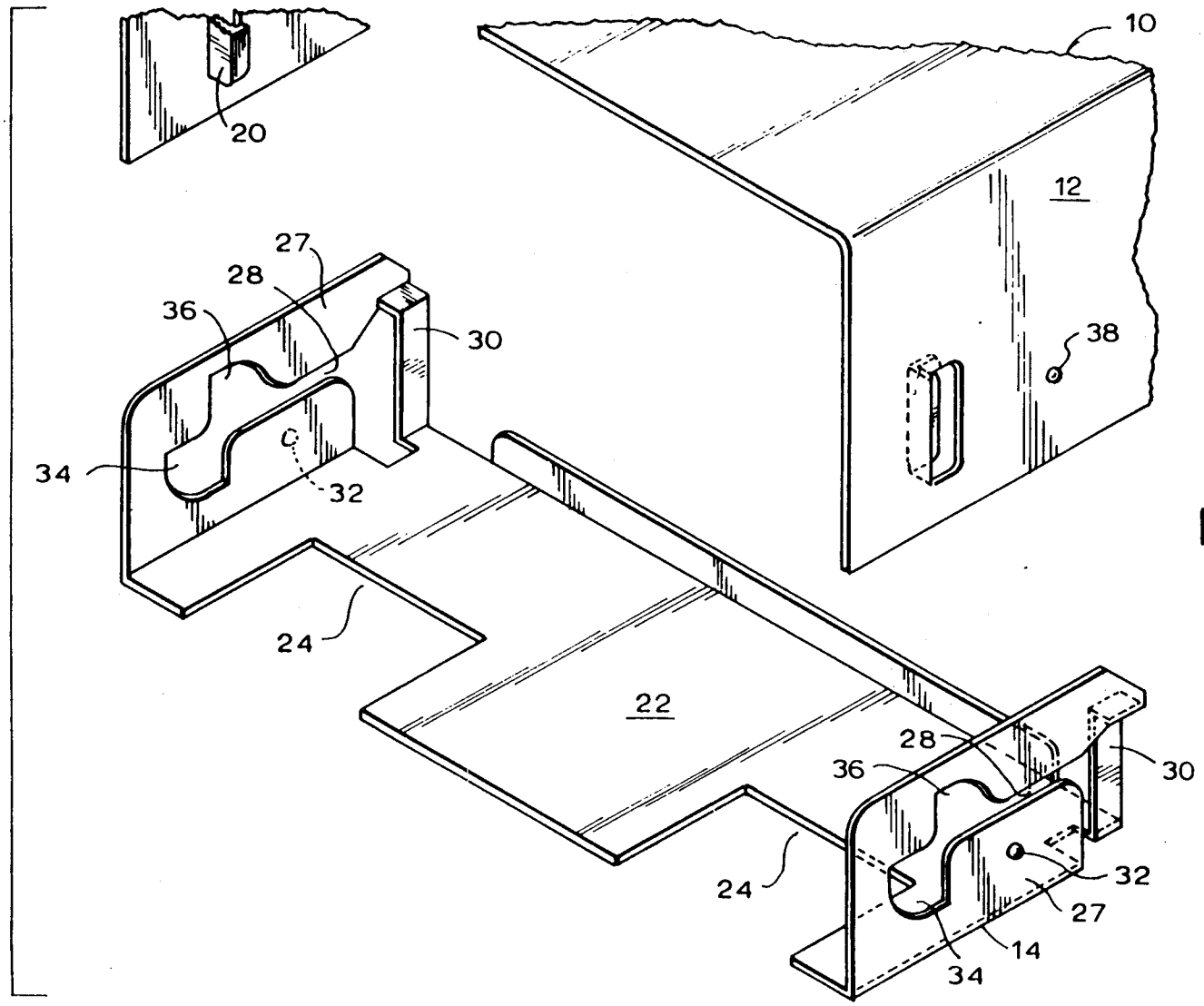
FIG. 3 is a perspective view of the end of the housing and the socket assembly of the present invention.

Referring now to the drawings in detail wherein like numerals indicate like elements throughout the several views, FIG. 1 discloses apparatus 10 which includes housing 12 and socket assemblies 14. Housing 12 has an inverted U-shaped cross section as shown in FIG. 2 with downwardly descending legs 18. Both legs include an inwardly extending L-shaped vertical tab 20 on both ends. As may be seen more clearly in FIG. 3, these tabs 20 may be formed by cutting a C-shape in the legs 18 and bending the material formed therein toward the interior of housing 12 in an L-shaped form. Socket assemblies 14, as shown in FIG. 3, have a U-shaped cross section with a lateral support portion 22 which provide notches 24 for the engagement of lamp sockets 26, which in turn, engage fluorescent light bulbs 100. These notches 24 are designed so as to engage standard lamp sockets 26. The socket assembly legs 27 include a channel 28, a support section 30 which is indented a distance at least equal to the depth of tab 20, and a detent element 32 (either concave or convex) The channel 28 includes expanded portions 34, 36 which are in the shape of a quarter circle with the diameter equal to the length of tab 20. These quarter circles are from a common imaginary circle with faces along channel 28, and separated 90 degrees from each other so as to provide a means for the socket assemblies 14 to rotate ninety degrees when the tab 20 is fully inserted into the channels 28.

Figure 4:
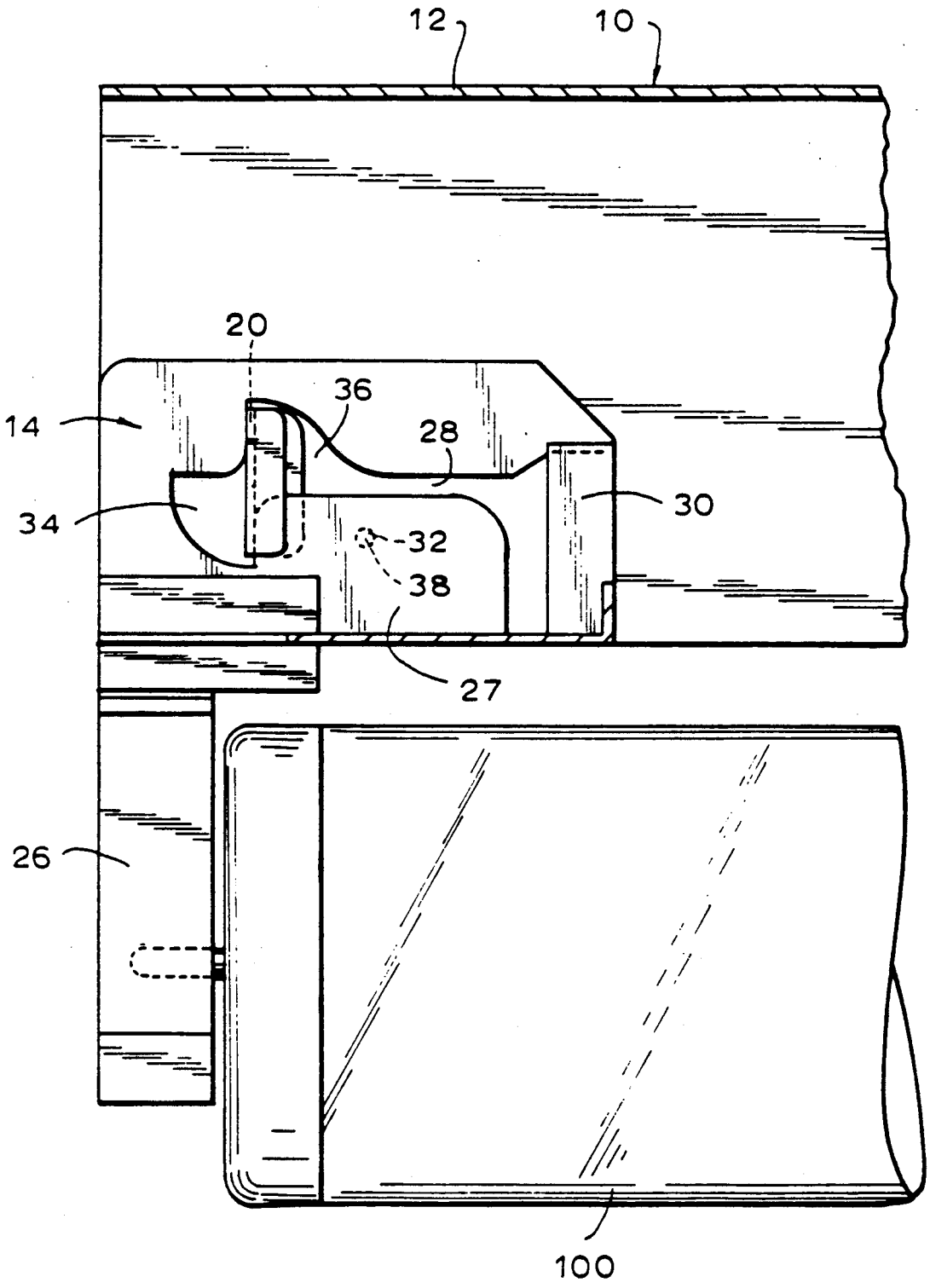
FIG. 4 is a close-up view, partly in cross section, of the present invention with the socket assembly extended so as to engage a fluorescent light bulb.
Figure 5:
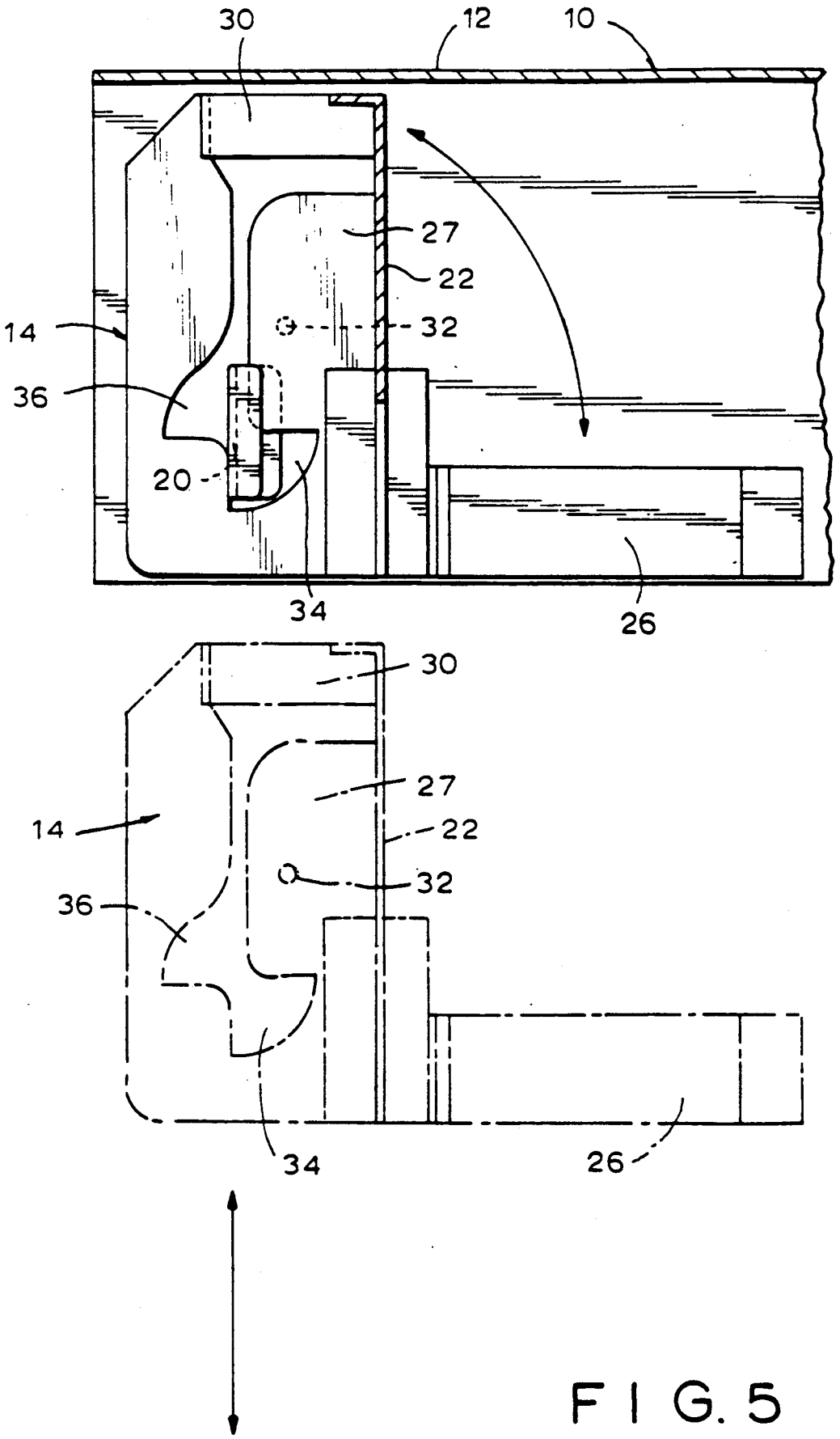
FIG. 5 is a close-up view, partly in cross section, showing the socket assembly in a removed position from the housing and, in phantom, the socket assembly in a folded position suitable for shipping.

In the assembling of this device 10, whether it be at the factory or the construction site, the socket assembly 14 is positioned with channel 28 engaging tab 20 and simply slid into the housing 12, ideally without the necessity of deforming housing 12. FIG. 5 shows the socket assembly 14 removed from the housing 12 and, in phantom, inserted into housing 12. When the socket assembly 14 is so inserted, the socket assembly 14 is in a protected position and can be shipped without fear of damaging the lamp sockets 26. When the housing 12 is installed and/or the lamp socket 26 is ready to be exposed so as to engage a fluorescent bulb 100, the socket assembly 14 is rotated so that expanded portions 34,36 of channel 28 allow tab 20 to rotate with respect to socket assembly 14. Detent element 32 engages a complementary detent element 38 in the housing. This transforms the configuration of apparatus 10 from that shown in the upper portion of FIG. 5 to that shown in FIG. 4. In order to remove the socket assembly 14 or merely to place the socket assembly 14 into a protected position for shipping, a reversed sequence is effected.

Thus, in accordance with the above, the aforementioned objects are effectively attained.

Having thus described the invention, what is claimed is:

1. A fluorescent light fixture comprising:

a housing including a guide means comprising a tab with an L-shaped cross section inwardly extending from said housing;

at least one socket assembly comprising at least one fluorescent light socket and a channel for engaging said guide means including an enlarged portion within said channel for rotating said socket assembly with respect to said housing from a first position wherein said light socket is positioned to engage a fluorescent light bulb and a second position wherein said light socket is protected within said housing;

wherein said enlarged portion is comprised of two quarter circles of a common center and a diameter substantially equal to a length of said tab, said quarter circles each having an edge in parallel to an unenlarged portion of said channel, and said quarter circles having 90 degrees therebetween; and wherein said socket assembly can be removed from said housing by a straight-line movement from said second position.

2. The fixture of claim 1 wherein said socket assemblies include a support portion over an opening of said channel which is indented by a distance at least equal to a depth of said tab.

3. The fixture of claim 1 wherein said channel engages said guide means in a straight sliding action without necessity of deforming said housing to achieve engagement.

4. The fixture in accordance with claim 1 wherein said socket means and said housing include detent means for securing said first position.

5. The fixture of claim 4 wherein said detent means comprises a dimple in said socket assembly and a corresponding protrusion in said housing.

* * * * *